US007918353B1

(12) United States Patent
Luberto

(10) Patent No.: US 7,918,353 B1
(45) Date of Patent: Apr. 5, 2011

(54) DISPLAY AND DISPENSING APPARATUS

(75) Inventor: Michael D. Luberto, Rivervale, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 521 days.

(21) Appl. No.: 11/676,772

(22) Filed: Feb. 20, 2007

(51) Int. Cl.
*A47F 1/04* (2006.01)

(52) U.S. Cl. ..... 211/59.3; 312/61

(58) Field of Classification Search ..... 211/59.3, 211/59.2, 184; 312/60, 61, 71, 86; 108/60, 108/61

See application file for complete search history.

(56) References Cited

U.S. PATENT DOCUMENTS

| | | | | |
|---|---|---|---|---|
| 2,934,212 | A | 4/1960 | Jacobson | |
| 3,035,587 | A | 5/1962 | Schade | |
| 3,308,961 | A * | 3/1967 | Chesley | 211/59.3 |
| 4,830,201 | A * | 5/1989 | Breslow | 211/184 |
| 5,111,942 | A * | 5/1992 | Bernardin | 211/59.3 |
| 5,190,186 | A | 3/1993 | Yablans et al. | |
| 5,469,976 | A | 11/1995 | Burchell | |
| 5,833,076 | A | 11/1998 | Harres et al. | |
| 6,041,720 | A | 3/2000 | Hardy | |
| 6,142,317 | A * | 11/2000 | Merl | 211/59.3 |
| 6,648,151 | B2 | 11/2003 | Battaglia et al. | |
| 6,823,997 | B2 * | 11/2004 | Linden et al. | 211/59.3 |
| 7,028,852 | B2 * | 4/2006 | Johnson et al. | 211/59.3 |
| 7,201,281 | B1 * | 4/2007 | Welker | 211/59.3 |
| 7,500,571 | B2 * | 3/2009 | Hawkinson | 211/59.3 |
| 2004/0245197 | A1 * | 12/2004 | McElvaney | 211/184 |
| 2005/0077260 | A1 * | 4/2005 | Mueller et al. | 211/59.3 |
| 2005/0098515 | A1 | 5/2005 | Close | |
| 2005/0199563 | A1 * | 9/2005 | Richter et al. | 211/59.3 |
| 2006/0049122 | A1 * | 3/2006 | Mueller et al. | 211/59.3 |
| 2007/0090068 | A1 * | 4/2007 | Hardy | 211/59.3 |

* cited by examiner

*Primary Examiner* — Janet M Wilkens
*Assistant Examiner* — Dan Rohrhoff
(74) *Attorney, Agent, or Firm* — Arthur Jacob

(57) ABSTRACT

An apparatus for displaying and dispensing merchandise in the form of packages arranged serially along a path of travel leading to a dispensing location at a point-of-purchase is selectively adjustable to accommodate packages of different dimensions. A pusher track assembly and dividers, each having a near end and a far end, readily are placed at selected relative locations along a display shelf and are secured in place adjacent the near ends to guide and move the packages along the path of travel to the dispensing location. Stabilizing arrangements located adjacent the near ends stabilize and maintain the pusher track assembly and the dividers in alignment with the path of travel without the necessity for securing the far ends independent of the near end securement in order to maintain the desired alignment of the pusher track assembly and the dividers.

20 Claims, 7 Drawing Sheets

DISPLAY AND DISPENSING APPARATUS

BACKGROUND OF THE INVENTION

1. Field of the Invention

The present invention relates generally to the point-of-purchase display and dispensing of merchandise and pertains, more specifically, to apparatus for enabling the display and ready dispensing of serially arranged merchandise packages at a point-of-purchase dispensing location, while facilitating the accommodation of merchandise packages of different dimensions.

2. Description of Related Art

An ever-increasing variety of packaged merchandise offered for sale at points-of-purchase located along store shelves has led to a requirement for better organization of such merchandise, along with increased ease of selection and dispensing, together with a simplified accommodation of items of different dimensions. Display and dispensing trays have become staples in assisting the organizing, display and dispensing of such items.

BRIEF SUMMARY OF THE INVENTION

The present invention provides an apparatus for displaying and dispensing merchandise at a point-of-purchase and for facilitating the accommodation of such items at the point-of-purchase. As such, the present invention attains several objects and advantages, some of which are summarized as follows: Provides an apparatus which facilitates the display and smooth, uninterrupted dispensing of serially arranged merchandise packages at a point-of-purchase, together with ease of selective adjustment to accommodate merchandise packages of different dimensions; enables increased versatility in dispensing merchandise at a point-of-purchase while allowing simplified adjustments at the point-of-purchase to accommodate merchandise being dispensed; facilitates the organization of merchandise for display and dispensing at points-of-purchase located along store shelves; provides simplified apparatus constructed economically of fewer component parts; allows ease of set-up and use for accommodating a wide variety of merchandise displayed and dispensed at a point-of-purchase; offers less obtrusive and aesthetically more desirable apparatus for the display and dispensing of merchandise packages; provides a less complex apparatus for the display and dispensing of merchandise at a point-of-purchase, capable of exemplary performance over a relatively long service life.

The above objects and advantages, as well as further objects and advantages, are attained by the present invention which may be described briefly as an apparatus for displaying and dispensing merchandise at a point-of-purchase adjacent a display shelf extending in lateral directions, the merchandise being in the form of packages arranged serially along a path of travel extending longitudinally toward a forward dispensing location placed at the point-of-purchase, the apparatus comprising: a pusher track assembly for extending along a longitudinal direction adjacent the path of travel in juxtaposition with the serially arranged packages, the pusher track assembly including a near end for placement adjacent the forward dispensing location, and a far end spaced longitudinally away from the near end; a securing arrangement for securing the near end of the pusher track assembly at a selected lateral location along the display shelf, with the pusher track assembly extending within a basal plane, the near end affixed against inadvertent movement in lateral directions within the basal plane, as well as against inadvertent movement in longitudinal directions within the basal plane, the securing arrangement including a retainer plate for affixation to the display shelf with the retainer plate extending along the lateral directions adjacent the point-of-purchase; a stabilizing arrangement for stabilizing the pusher track assembly against inadvertent movements of the far end in lateral directions within the basal plane when the near end is secured at the selected lateral location, the stabilizing arrangement including: a pair of keys extending in lateral directions along one of the retainer plate and the pusher track assembly, adjacent the near end of the pusher track assembly; and a pair of keyways extending in lateral directions along another of the retainer plate and the pusher track assembly, adjacent the near end of the pusher track assembly; the keys and the keyways being dimensioned and configured for complementary interengagement, with each key interlocked longitudinally with a complementary keyway, the keys being spaced apart and the keyways being spaced apart in longitudinal directions by a predetermined longitudinal spacing, and engaged along prescribed lateral spans, the longitudinal spacing being great enough and the lateral spans being extensive enough such that upon interengagement of the complementary keys and keyways, canting of the pusher track assembly relative to the retainer plate within the basal plane essentially is precluded and the pusher track assembly is stabilized, in alignment with the longitudinal direction.

In addition, the present invention includes an apparatus for displaying and dispensing merchandise at a point-of-purchase adjacent a display shelf extending in lateral directions, the merchandise being in the form of packages arranged serially along a path of travel extending longitudinally toward a forward dispensing location placed at the point-of-purchase, the apparatus comprising: at least one divider for extending along a longitudinal direction adjacent the path of travel in juxtaposition with the serially arranged packages, the divider including a near end for placement adjacent the forward dispensing location, and a far end spaced longitudinally away from the near end; a securing arrangement for securing the near end of the divider at a selected lateral location along the display shelf, with the divider extending within a basal plane, the near end affixed against inadvertent movement in lateral directions within the basal plane, as well as against inadvertent movement in longitudinal directions within the basal plane, the securing arrangement including a retainer plate for affixation to the display shelf with the retainer plate extending along the lateral directions adjacent the point-of-purchase; a stabilizing arrangement for stabilizing the divider against inadvertent movements of the far end in lateral directions within the basal plane when the near end is secured at the selected lateral location, the stabilizing arrangement including: a pair of keys extending in lateral directions along one of the retainer plate and the divider, adjacent the near end of the divider; and a pair of keyways extending in lateral directions along another of the retainer plate and the divider, adjacent the near end of the divider; the keys and the keyways being dimensioned and configured for complementary interengagement, with each key interlocked longitudinally with a complementary keyway, the keys being spaced apart and the keyways being spaced apart in longitudinal directions by a predetermined longitudinal spacing, and engaged along prescribed lateral spans, the longitudinal spacing being great enough and the lateral spans being extensive enough such that upon interengagement of the complementary keys and keyways, canting of the divider relative to the retainer plate within the basal plane essentially is precluded and the divider is stabilized, in alignment with the longitudinal direction.

BRIEF DESCRIPTION OF THE SEVERAL VIEWS OF THE DRAWING

The invention will be understood more completely, while still further objects and advantages will become apparent, in the following detailed description of a preferred embodiment of the invention illustrated in the accompanying drawing, in which.

DETAILED DESCRIPTION OF THE INVENTION

Figure 1:
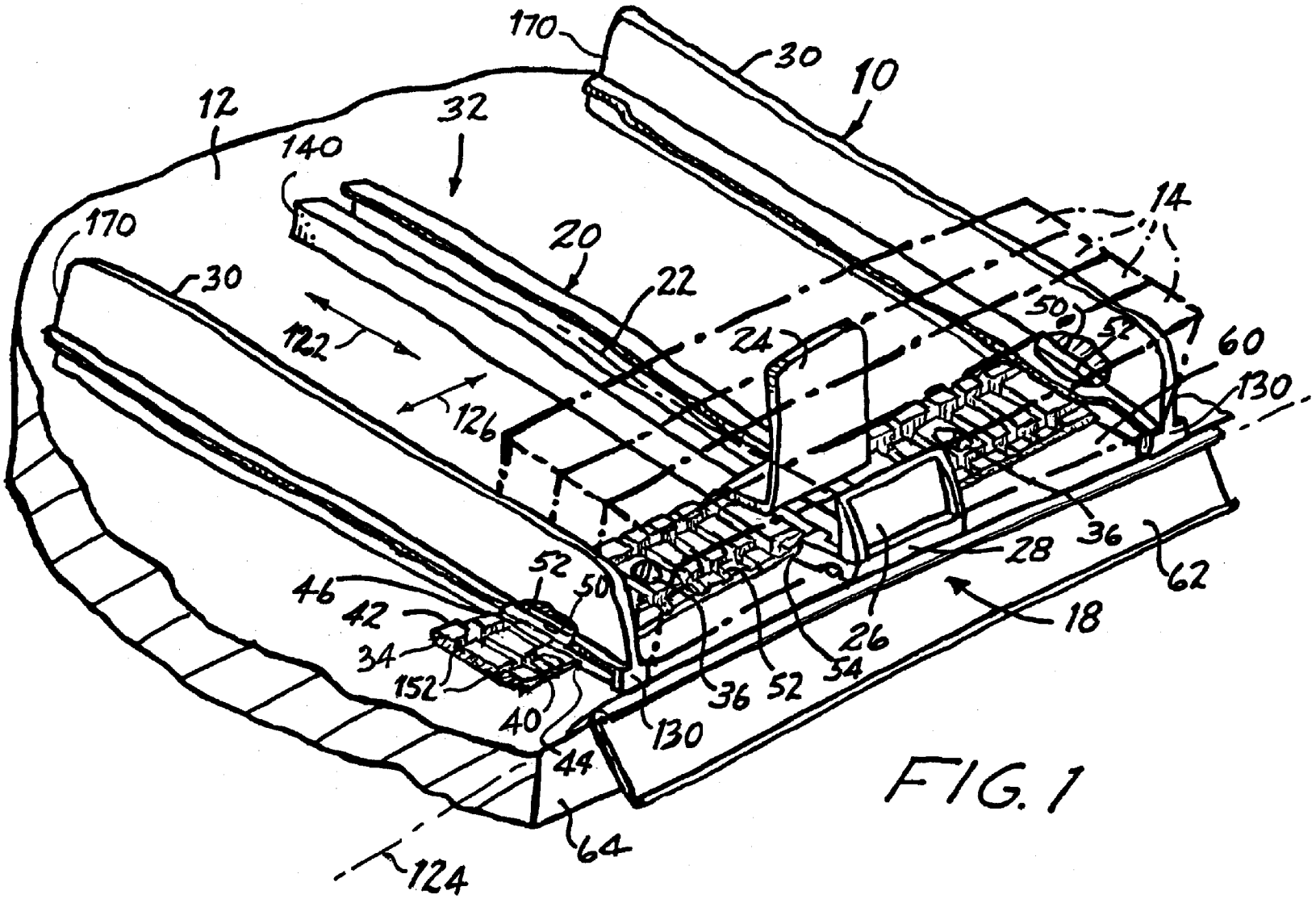
FIG. 1 is a pictorial perspective view of a shelf organizing apparatus utilizing an improvement constructed in accordance with the present invention.

Referring now to the drawing, and especially to FIG. 1 thereof, a shelf organizing apparatus 10 is shown installed upon a shelf 12 for presenting merchandise packages 14 for display and dispensing at a point-of-purchase 18. Apparatus 10 includes a pusher track assembly 20 upon which merchandise packages 14 are arranged serially along a path of travel 22 extending longitudinally between a pusher 24 and a gate 26 placed at a forward dispensing location 28 at the point-of-purchase 18. A pair of side dividers 30 establish a bay 32 between the dividers 30, within which bay 32 the merchandise packages 14 are confined for providing an organized display along the shelf 12, while assisting in maintaining alignment of the serial merchandise packages 14 along the path of travel 22 for smooth and uninterrupted dispensing at point-of-purchase 18.

A retainer plate 34 is affixed to shelf 12, as by threaded fasteners 36, and provides a forward lip 40 and a rearward lip 42 extending along the shelf 12 in lateral directions transverse to the longitudinal direction of path of travel 22. Corresponding forward and rearward fingers 44 and 46 are carried by the dividers 30 and are engaged with respective lips 40 and 42 to hold the dividers 30 juxtaposed with shelf 12. At the same time, a tongue 50 is integral with and depends from each of the dividers 30, between corresponding fingers 44 and 46, to engage a selected groove 52 of a plurality of grooves 52 spaced apart laterally along the retainer plate 34 to place each divider 30 at a selected location along the retainer plate 34.

In a similar manner, pusher track assembly 20 includes forward hooks 54 for engaging forward lip 40, rearward fingers 56 for engaging rearward lip 42, and tongues 58 (see FIGS. 4 and 6) for engaging a selected groove 52 along the retainer plate 34. With each tongue 50 and 58 placed within a corresponding selected groove 52, and with the fingers 44, 46 and 56, and hooks 54 engaged with corresponding lips 40 and 42, the dividers 30 and the pusher track assembly 20 are secured in place upon shelf 12 for an organized presentation of the serially arranged merchandise packages 14. A front plate 60 carries a channel 62 which extends along the front edge 64 of the shelf 12 for displaying identification information pertaining to the merchandise packages 14 offered at the point-of-purchase 18.

Figure 2:
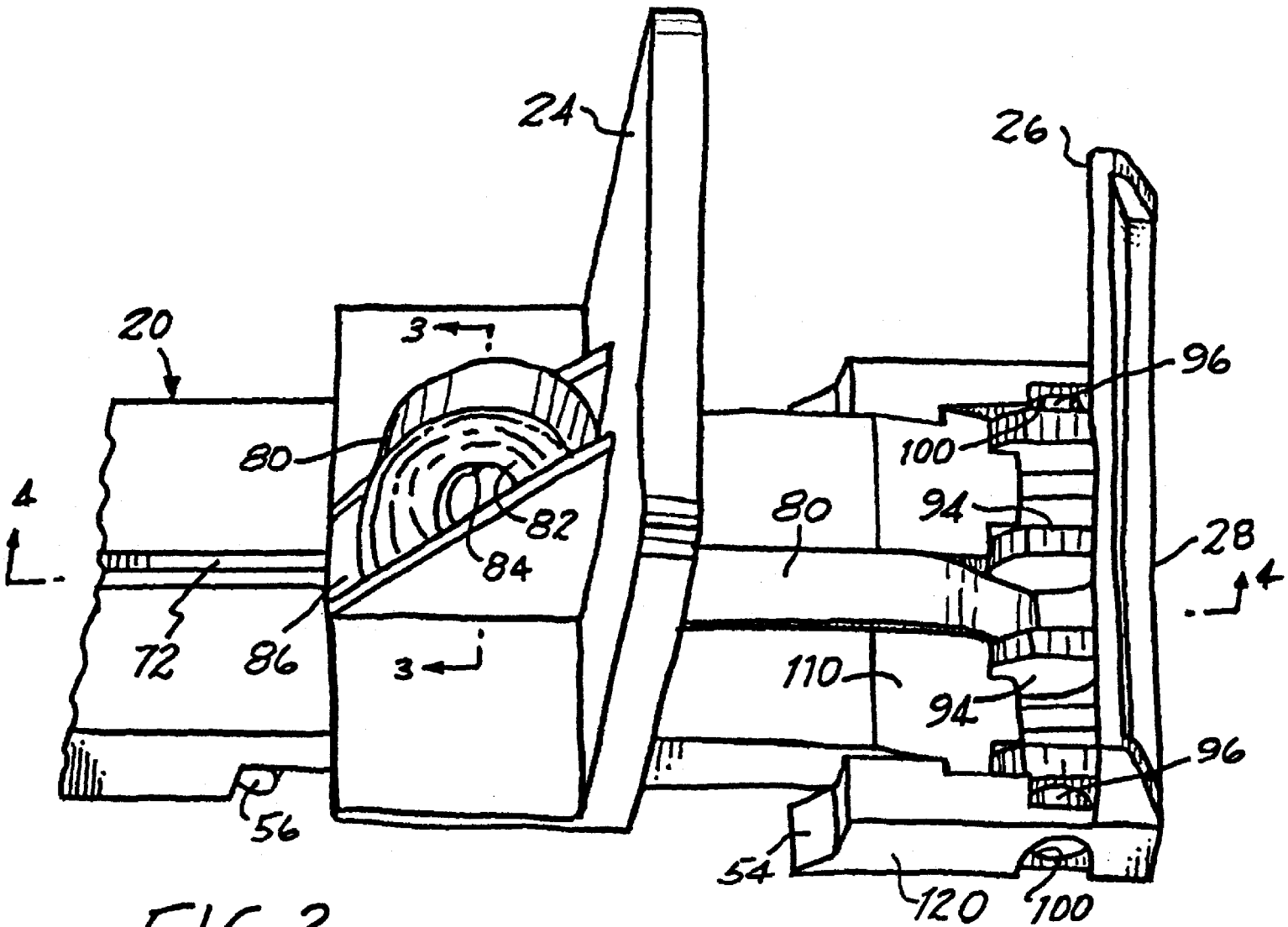
FIG. 2 is an enlarged fragmentary pictorial view of a portion of the apparatus.
Figures 3, 4:
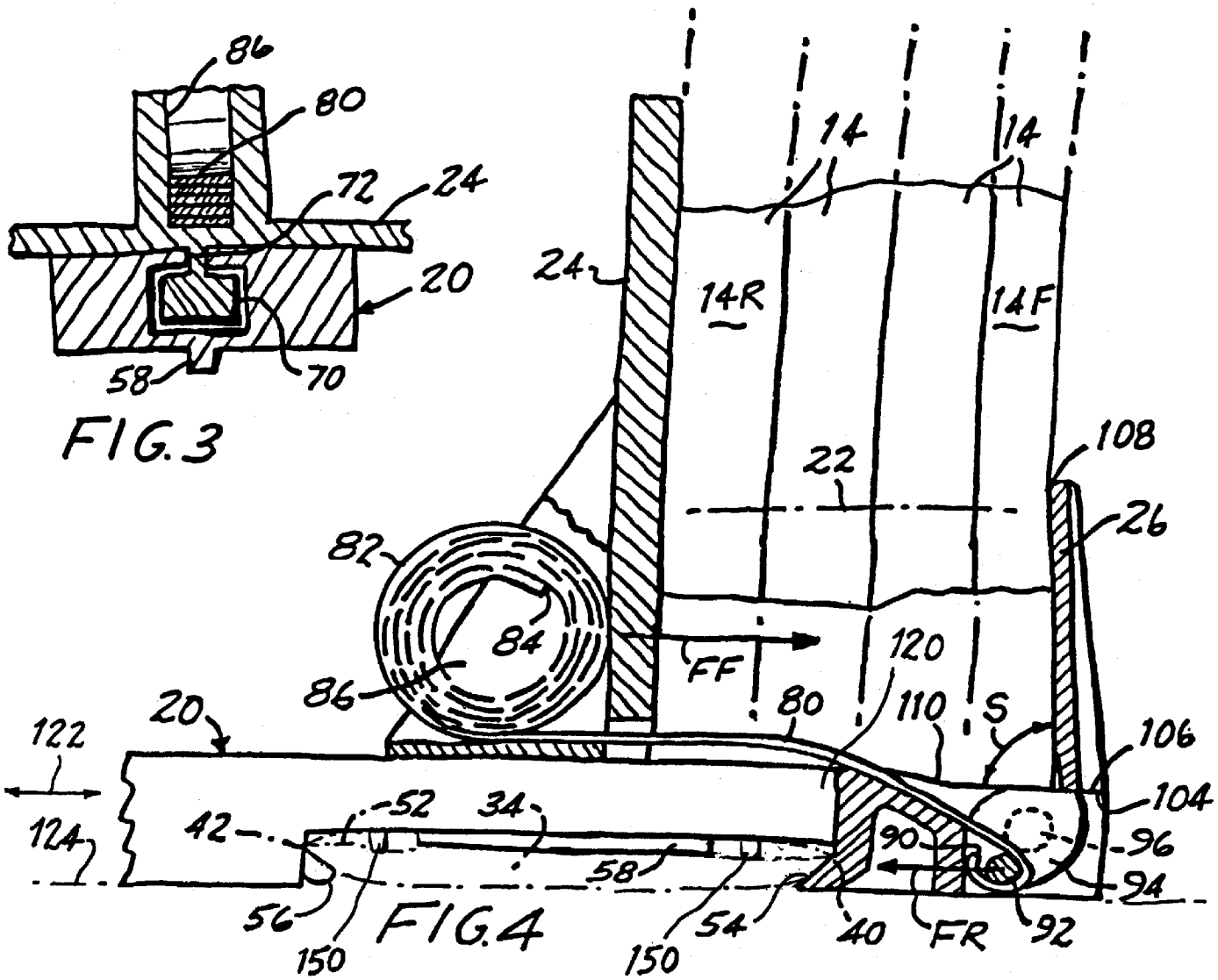
FIG. 3 is a fragmentary cross-sectional view taken along line 3-3 of FIG. 2.
FIG. 4 is a cross-sectional view taken along line 4-4 of FIG. 2.

Turning now to FIGS. 2 through 4, as well as to FIG. 1, pusher track assembly 20 includes a slide 70 engaged with a track 72 for sliding movement along track 72 in longitudinal directions parallel with path of travel 22. Slide 70 carries pusher 24 which is integral with slide 70 and projects upwardly from slide 70 into path of travel 22 so as to engage the rearward-most merchandise package 14R behind the package 14R. Gate 26 is placed at the dispensing location 28 and engages the forward-most merchandise package 14F. A biasing member in the form of a ribbon spring 80 is coiled to establish a coil 82 adjacent a first end 84 of the spring 80, and the coil 82 is placed in a compartment 86 located at the rear of the pusher 24 and is engaged with the pusher 24.

A second end 90 of the spring 80 is coupled to gate 26 by a coupling arrangement which includes attachment of the second end 90 at a location 92 to a crank 94 integral with the gate 26, the crank 94 enabling location 92 to be placed outside, and preferably below, the path of travel 22. Pivot pins 96 are integral with gate 26 and are journaled at 100 to complete a pivotal connection which mounts gate 26 for pivotal movement within pusher track assembly 20. In this manner, the single coiled spring 80 establishes a first biasing force FF in a forward direction, the first biasing force being transmitted to the pusher 24 at coil 82, biasing the pusher 24, and consequently the serially arranged merchandise packages 14, in a forward direction. At the same time, the single coiled spring 80 establishes a second biasing force FR in a rearward direction, which biasing force FR pulls upon crank 94 to bias the gate 26 into a stop position, illustrated in FIG. 4, wherein the gate 26 intercepts and engages the forward-most merchandise package 14F. The placement of location 92 below the path of travel 22, enabled by the coupling arrangement which couples the second end 90 of the spring 80 to gate 26 through crank 94, assures that the second end 90 of spring 80 is maintained outside the path of travel 22 so as not to impede placement of the forward-most merchandise package 14F fully against gate 26 and subsequent selective dispensing of the forward-most merchandise package 14F at the dispensing location 28. Further, by maintaining the second end 90 of spring 80 outside the path of travel 22, engagement of the second end 90 with the forward-most merchandise package 14F, and any consequent damage or marring of the forward-most package 14F, is avoided.

A stop shoulder 104 on the gate 26 engage a forward edge 106 on the pusher track assembly 20 so that upon being biased into the stop position, gate 26 is canted rearwardly at a relatively steep acute angle S with respect to the path of travel 22. The acute angle S assures that gate 26 will engage the forward-most merchandise package 14F at a location 108 placed far enough from track 72 to maintain stability in the serially arranged merchandise packages 14, while facilitating selective removal of the forward-most merchandise package 14F for dispensing the package 14F at the dispensing location 28. The preferred angle S is about 87°.

Figure 5:
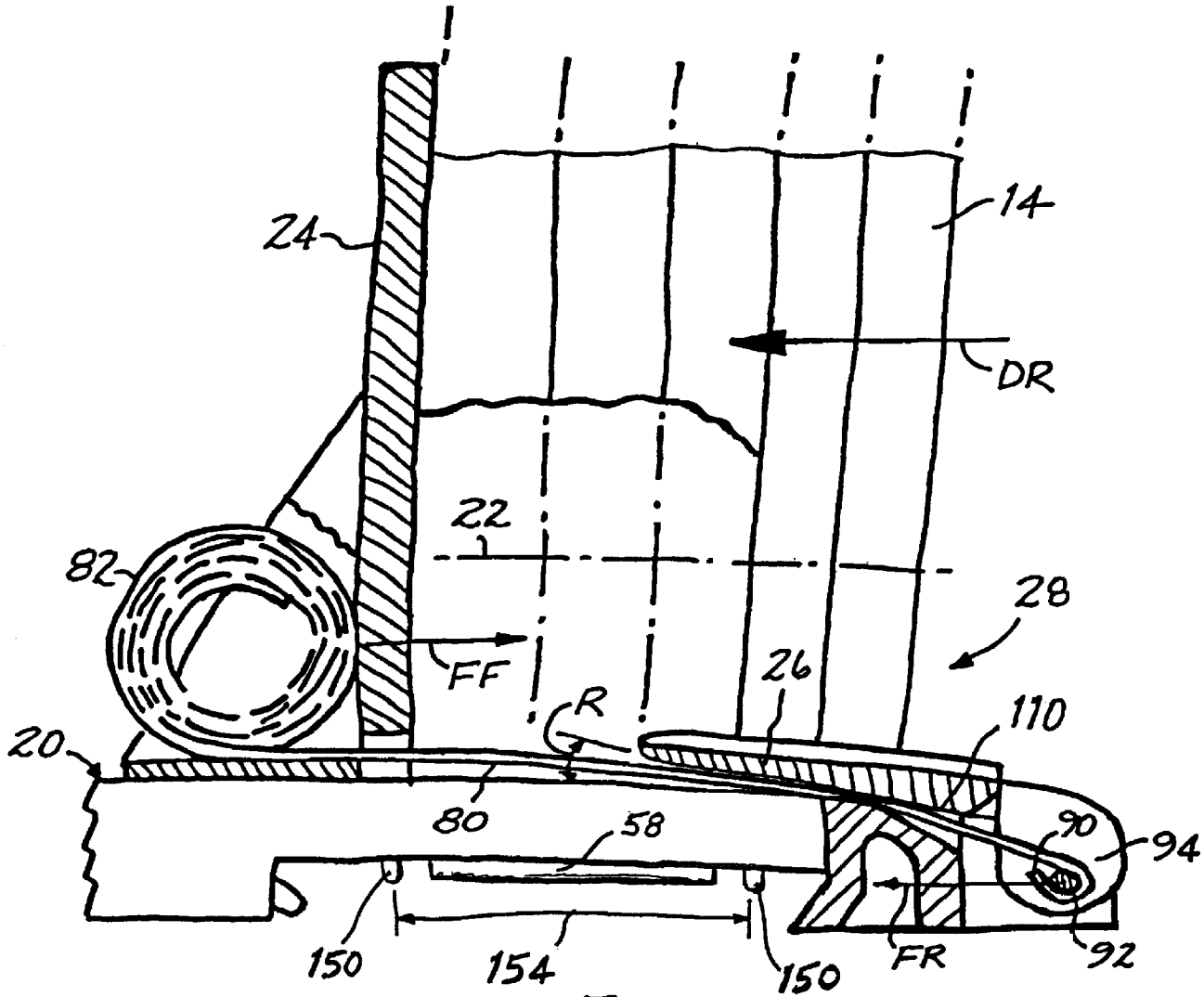
FIG. 5 is a cross-sectional view similar to FIG. 4, and showing component parts in another operating position.

When it becomes necessary or desirable to re-stock the merchandise packages 14, pusher track assembly 20 enables convenient reloading to be accomplished by inserting new merchandise packages 14 in a rearward direction DR through the dispensing location 28. As seen in FIG. 5, reloading is accomplished by pushing back upon gate 26 to pivotally move gate 26 against biasing force FR into a retracted position against a stop surface 110, wherein the gate 26 is canted rearwardly at a relatively shallow acute angle R with respect to the path of travel 22. The shallow angle R enables access to the pusher track assembly 20 from the front of the pusher track assembly 20 for establishing replenished serially arranged merchandise packages 14 in place against pusher 24. Further, the shallow angle R assures that upon release of gate 26 after restocking, the biasing force FF will be transmitted to gate 26, through the serially arranged merchandise packages 14, to assist the biasing force FR in returning gate 26 to the stop position, thereby preventing jamming of the gate 26 at the retracted position. The preferred shallow acute angle R is about 10°.

The utilization of the single spring 80 reduces the number of component parts and the complexity of pusher track assembly 20, while at the same time providing biasing forces FF and FR directed in opposite directions and in magnitudes which facilitate dispensing and reloading operations while militating against unwanted inadvertent dispensing of more than one merchandise package at a time, and against jamming during restocking.

Smooth and uninterrupted dispensing of merchandise packages 14 at point-of-purchase 18 is assured by aligning pusher track assembly 20 and dividers 30 with precision along longitudinal directions so that merchandise packages 14 are maintained in alignment along path of travel 22. Precise longitudinal alignment of merchandise packages 14 will prevent skewing and concomitant jamming of merchandise packages 14 as the merchandise packages 14 are pushed along the path of travel 22. To that end, the near end 120 of pusher track assembly 20 is secured to shelf 12 by the securing arrangement described above, that is, forward hooks 54 and rearward fingers 56 of pusher track assembly 20 engage counterpart forward and rearward lips 40 and 42 of retainer plate 34 for securing the pusher track assembly 20 against movements in longitudinal directions 122 within a basal plane 124, while tongues 58 engage respective selected grooves 52 in retainer plate 34 to preclude inadvertent movements of the pusher track assembly 20 in lateral directions 126 within the basal plane 124. Likewise, the near end 130 of each divider 30 is secured against movements in longitudinal directions 122 and lateral directions 126 within basal plane 124 by the engagement of fingers 44 and 46 with respective lips 40 and 42 of retainer plate 34, and the placement of tongue 50 within a selected groove 52 when each divider 30 is located at a selected location along the retainer plate 34.

Figure 6:
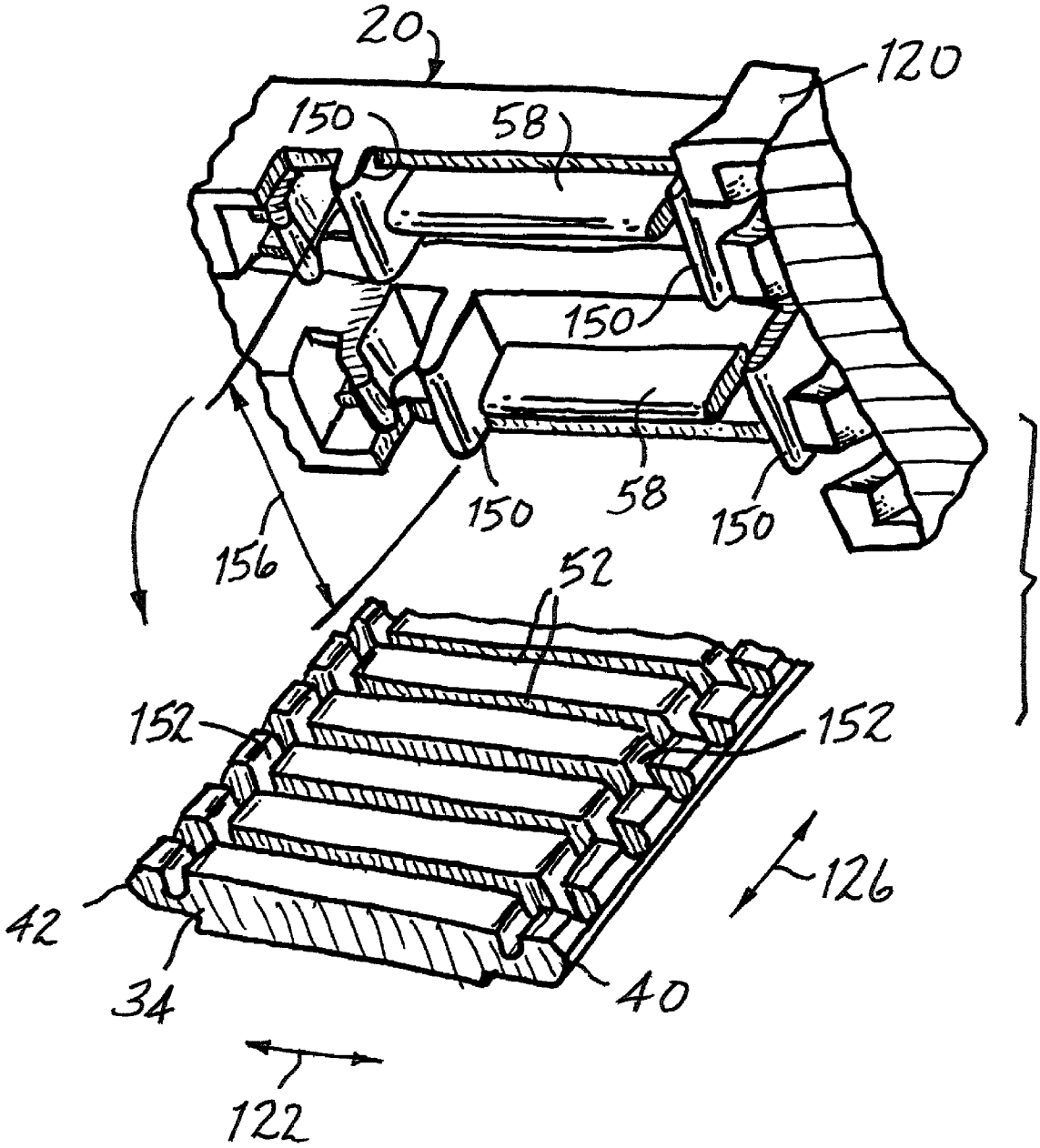
FIG. 6 is an exploded fragmentary pictorial view showing a portion of the apparatus illustrated in FIG. 5, and another component part in cross-section.
Figure 7:
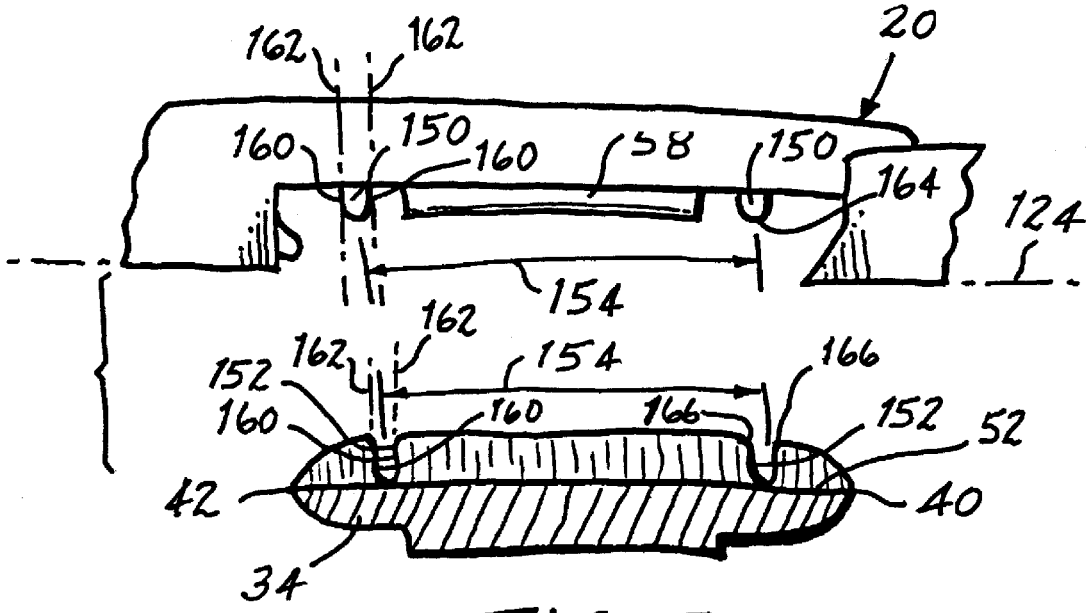
FIG. 7 is an exploded fragmentary side elevational view showing the portion of the apparatus shown in FIG. 6, and another component part in cross-section.
Figure 8:
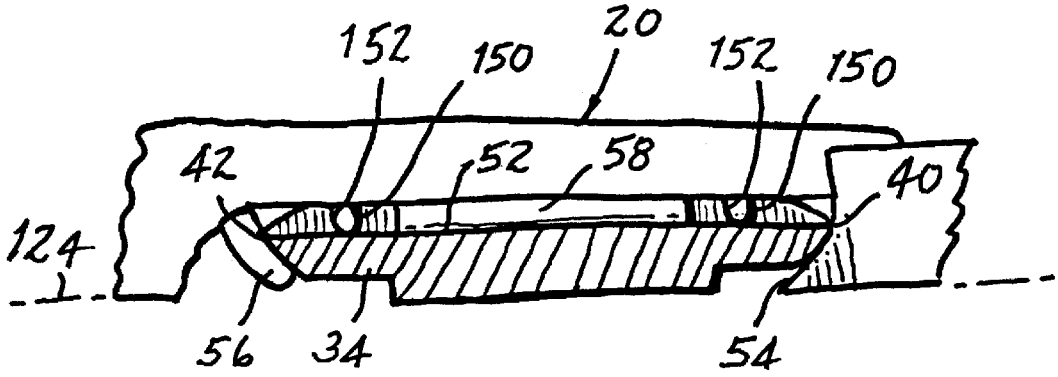
FIG. 8 is a fragmentary view of the portion of the apparatus illustrated in FIG. 7, but with the component parts engaged.

In order to assure that the pusher track assembly 20 is maintained in such longitudinal alignment, a stabilizing arrangement stabilizes the pusher track assembly 20 against inadvertent movements of the far end 140 of the pusher track assembly 20 in lateral directions 126 within basal plane 124 when the near end 120 is secured as described above. As best seen in FIGS. 6 through 8, as well as in FIGS. 1, 4 and 5, the stabilizing arrangement includes a pair of keys 150 extending in lateral directions 126, preferably along and integral with pusher track assembly 20, adjacent the near end 120, and a pair of keyways 152 extending in lateral directions 126, preferably along retainer plate 34. The keys 150 and keyways 152 are dimensioned and configured for complementary interengagement, with each key 150 fully engaged with a counterpart complementary keyway 152 when the pusher track assembly 20 is secured in place along the retainer plate 34.

The keys 150 are spaced apart in longitudinal directions 122 by a predetermined longitudinal spacing 154, and keyways 152 are spaced apart longitudinally by the same longitudinal spacing 154 so that the keys 150 are capable of being fitted within corresponding keyways 152 in a longitudinally interlocked relationship, that is, interlocked against relative longitudinal movement along prescribed lateral spans 156 provided by the keys 150. Upon interlocking keys 150 with counterpart keyways 152, the longitudinal spacing 154 is great enough and the lateral spans 156 are extensive enough essentially to preclude canting of the pusher track assembly 20 relative to the retainer plate 34 within the basal plane 124, and concomitant movements of the far end 140 in lateral directions 126 within the basal plane 124, thereby maintaining the pusher track assembly 20 in the desired longitudinal alignment. At the same time, alignment of the keys 150 and keyways 152 along the lateral directions 126, together with the continuous extension of the keyways 152 along the retainer plate 34, enables selective placement of the pusher track assembly 20 at any selected location along retainer plate 34 permitted by the engagement of tongue 58 with a groove 52.

The preferred cross-sectional configuration of the keys 150 and keyways 152 is one which provides confronting engaging surfaces 160 extending within engagement planes 162 generally normal to the basal plane 124. Such a cross-sectional configuration establishes a snug fit between keys 150 and keyways 152 for precluding the aforesaid canting, while enabling ease in the selective insertion of keys 150 into keyways 152 and selective withdrawal of keys 150 from keyways 152 in altitudinal directions, normal to the basal plane 124, for placing the pusher track assembly 20 at a selected location along the retainer plate 34. Insertion of the keys 150 into keyways 152 is facilitated by rounded edges 164 along the keys 150 and rounded edges 166 along the keyways 152. In this manner, lateral movements of the far end 140 within the basal plane 124 are precluded and the pusher track assembly 20 is provided with a stable longitudinal alignment without the necessity for securing the far end 140 in place independent of the securing arrangement at the near end 120. Since the near end 120 is readily accessible, and the far end 140 is remote and not easily reached, selective adjustments of the location of the pusher track assembly 20 along the retainer plate 34 to accommodate merchandise packages of different dimensions are accomplished with ease, while the overall construction is much simplified.

Figure 9:
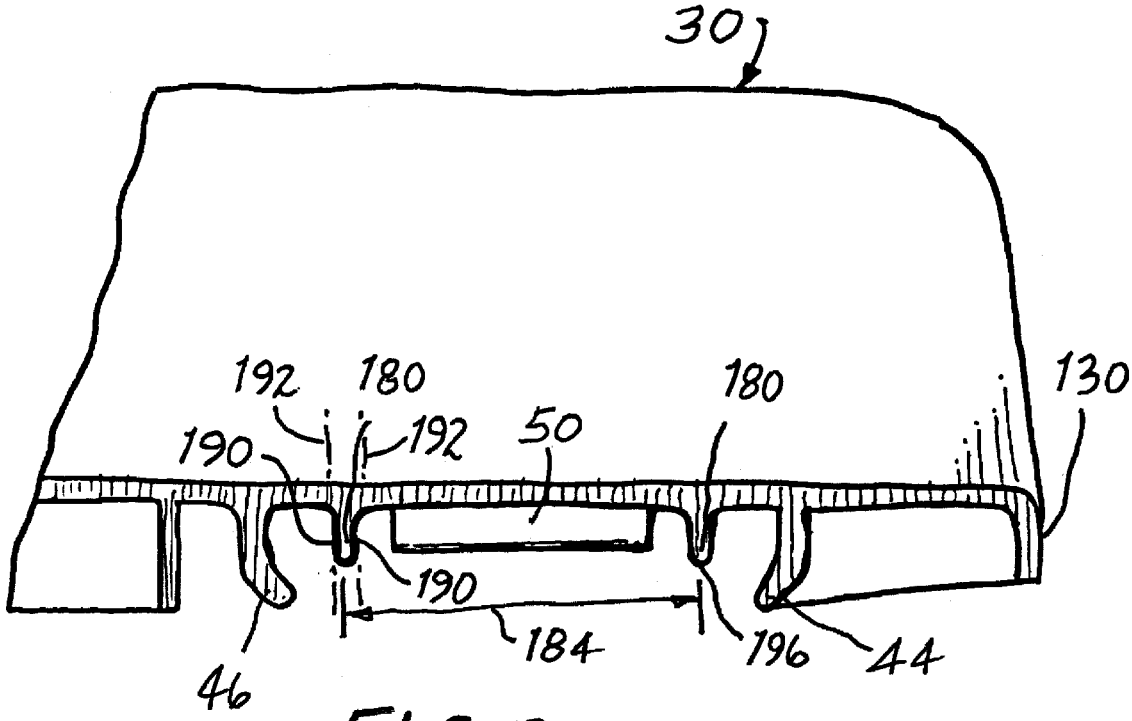
FIG. 9 is a fragmentary side elevational view showing a portion of another component part.
Figure 10:
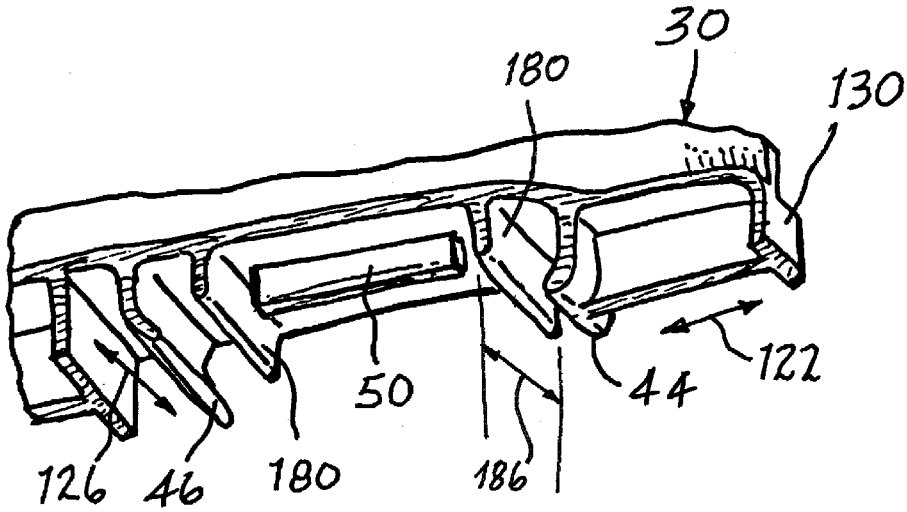
FIG. 10 is a pictorial view of the portion of the component part shown in FIG. 9.

In a similar manner, each divider 30 is stabilized by a further stabilizing arrangement against movements of the far end 170 of the divider 30 in the lateral directions 126 within basal plane 124. Turning to FIGS. 9 and 10, as well as to FIG. 1, the divider stabilizing arrangement includes a pair of keys 180 extending in the lateral directions 126, preferably along and integral with the divider 30, adjacent the near end 130, for engagement with a counterpart pair of keyways, the preferred counterpart pair of keyways being coincident with the pair of keyways 152 extending in the lateral directions 126, preferably along retainer plate 34. The keys 180 and keyways 152 are dimensioned and configured for complementary interengagement, with each key 180 to be fully engaged with a counterpart complementary keyway 152 when the divider 30 is secured in place along the retainer plate 34.

The keys 180 are spaced apart in longitudinal directions 122 by a predetermined longitudinal spacing 184, as are keyways 152, which longitudinal spacing 184 is the same as longitudinal spacing 154 so that the keys 180 can be fitted within corresponding keyways 152 in a longitudinally interlocked relationship. The keys 180 provide prescribed lateral spans 186 over which the keys 180 and keyways 152 are to be engaged. Upon interlocking keys 180 with counterpart keyways 152, the longitudinal spacing 184 is great enough and the lateral spans 186 are extensive enough essentially to preclude canting of each divider 30 relative to the retainer plate 34 within the basal plane 124, and concomitant movements of the far end 170 in lateral directions 126 within the basal plane 124, thereby maintaining the dividers 30 in the desired longitudinal alignment alongside the path of travel 22 of merchandise packages 14. At the same time, alignment of the keys 180 and keyways 152 along the lateral directions 126, together with the continuous extension of the keyways 152 along the retainer plate 34, enables selective placement of each divider 30 at any selected location along retainer plate 34 permitted by the engagement of a tongue 50 with a groove 52.

The preferred cross-sectional configuration of the keys 180 and keyways 152 is one which provides surfaces 190 extending within engagement planes 192 generally normal to the basal plane 124. Such a cross-sectional configuration establishes a snug fit between keys 180 and keyways 152 for precluding the aforesaid canting, while enabling ease in the selective insertion of keys 180 into keyways 152 and selective withdrawal of keys 180 from keyways 152 in altitudinal directions, normal to the basal plane 124, for placing each divider 30 at a selected location along the retainer plate 34. Keys 180 are provided with rounded edges 196 for facilitating insertion of the keys 180 into counterpart keyways 152. In this manner, lateral movements of the far end 170 of each divider 30 within the basal plane 124 are precluded and each divider 30 is provided with a stable longitudinal alignment without the necessity for securing the far end 170 in place independent of the securing arrangement at the near end 130. Since the near end 130 is readily accessible, and the far end 170 is remote and not easily reached, selective adjustments of the location of the dividers 30 along the retainer plate 34 to accommodate merchandise packages of different dimensions are accomplished with ease, while the overall construction is much simplified.

It will be seen that the present invention attains the several objects and advantages summarized above, namely: Provides an apparatus which facilitates the display and smooth, uninterrupted dispensing of serially arranged merchandise packages at a point-of-purchase, together with ease of selective adjustment to accommodate merchandise packages of different dimensions; enables increased versatility in dispensing merchandise at a point-of-purchase while allowing simplified adjustments at the point-of-purchase to accommodate merchandise being dispensed; facilitates the organization of merchandise for display and dispensing at points-of-purchase located along store shelves; provides simplified apparatus constructed economically of fewer component parts; allows ease of set-up and use for accommodating a wide variety of merchandise displayed and dispensed at a point-of-purchase; offers less obtrusive and aesthetically more desirable apparatus for the display and dispensing of merchandise packages; provides a less complex apparatus for the display and dispensing of merchandise at a point-of-purchase, capable of exemplary performance over a relatively long service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. An apparatus for displaying and dispensing merchandise at a point-of-purchase adjacent a display shelf extending in lateral directions, the merchandise being in the form of packages arranged serially along a path of travel extending longitudinally toward a forward dispensing location placed at the point-of-purchase, the apparatus comprising:

a pusher track assembly for extending along a longitudinal direction adjacent the path of travel in juxtaposition with the serially arranged packages, the pusher track assembly including a near end for placement adjacent the forward dispensing location, a far end spaced longitudinally away from the near end, a pusher movable along the path of travel and a selectively retractable gate adjacent the near end of the pusher track assembly;

a securing arrangement for securing the near end of the pusher track assembly to the display shelf at a selected lateral location along the display shelf, with the pusher track assembly extending within a basal plane, and the near end affixed against inadvertent movement in lateral directions within the basal plane, as well as against inadvertent movement in longitudinal directions within the basal plane, the securing arrangement including a retainer plate for affixation to the display shelf with the retainer plate extending along the lateral directions adjacent the point-of-purchase;

the retainer plate extending longitudinally from a laterally extending forward lip to a laterally extending rearward lip, and not beyond the forward and rearward lips, such that the retainer plate is bounded by the forward and rearward lips;

a forward hook depending from the pusher track assembly and extending in lateral directions along the pusher track assembly, adjacent the near end of the pusher track assembly in place for engaging the forward lip of the retainer plate;

a rearward finger depending from the pusher track assembly and extending in lateral directions along the pusher track assembly, adjacent the near end of the pusher track assembly, and spaced longitudinally rearwardly from the forward hook for engaging the rearward lip of the retainer plate when the forward hook is engaged with the forward lip such that the retainer plate is enveloped between the forward hook and the rearward finger;

at least one tongue extending in longitudinal directions along one of the retainer plate and the pusher track assembly, adjacent the near end of the pusher track assembly and placed intermediate the forward hook and the rearward finger, and intermediate the forward and rearward lips when the forward hook is engaged with the forward lip and the rearward finger is engaged with the rearward lip; and at least one groove extending in longitudinal directions along another of the retainer plate and the pusher track assembly, adjacent the near end of the pusher track assembly, the groove being complementary to the tongue;

a stabilizing arrangement for stabilizing the pusher track assembly against inadvertent movements of the far end in lateral directions within the basal plane when the near end is secured at the selected lateral location, the stabilizing arrangement including:

a pair of keys spaced apart longitudinally from one-another and extending in lateral directions along one of the retainer plate and the pusher track assembly, adjacent the near end of the pusher track assembly; and a pair of keyways spaced apart longitudinally from one-another and extending in lateral directions along another of the retainer plate and the pusher track assembly, adjacent the near end of the pusher track assembly;

the keys and the keyways, and the tongue and the groove being dimensioned, configured and located relative to one-another for complementary interengagement, with each key interlocked longitudinally with a complementary keyway, and the tongue interlocked with the groove, the keys being spaced apart and the keyways being spaced apart in longitudinal directions by a predetermined longitudinal spacing, and engaged along prescribed lateral spans, and the tongue and the groove extending longitudinally along a prescribed longitudinal length, the longitudinal spacing being great enough, the lateral spans being extensive enough, and the prescribed longitudinal length being great enough such that upon engagement of the forward hook with the forward lip, engagement of the rearward finger with the rearward lip, interengagement of the complementary keys and keyways, and engagement of the tongue and the groove, the engagement of the forward hook with the forward lip and the engagement of the rearward finger with the rearward lip captures the pusher track assembly upon the retainer plate, with the retainer plate enveloped between the forward hook and the rearward finger, while the engagement of the tongue and the groove in concert with interengagement of the complementary keys and keyways essentially precludes canting of the pusher track assembly relative to the retainer plate within the basal plane and the pusher track assembly is stabilized, in alignment with the longitudinal direction.

2. The apparatus of claim 1 wherein the keys and the tongue are on the pusher track assembly and the keyways and the groove are in the retainer plate.

3. The apparatus of claim 1 wherein the keys and the keyways include respective confronting engaging surfaces extending in respective engagement planes generally normal to the basal plane.

4. The apparatus of claim 3 wherein the engagement planes extend along lateral directions.

5. The apparatus of claim 4 wherein the keys and the tongue are on the pusher track assembly and the keyways and the groove are in the retainer plate.

6. The apparatus of claim 1 including:

at least one divider for extending along the longitudinal direction adjacent the path of travel in juxtaposition with the serially arranged packages, the divider including a near end for placement adjacent the forward dispensing location, and a far end spaced longitudinally away from the near end;

a further securing arrangement for securing the near end of the divider at a selected lateral location along the display shelf, with the divider extending within the basal plane, the near end affixed against inadvertent movement in lateral directions within the basal plane, as well as against inadvertent movement in longitudinal directions within the basal plane, the further securing arrangement including the aforesaid retainer plate for affixation to the display shelf with the retainer plate extending along the lateral directions adjacent the point-of-purchase;

a forward divider finger depending from the divider and extending in lateral directions along the divider, adjacent the near end of the divider in place for engaging the forward lip of the retainer plate:

a rearward divider finger depending from the divider and extending in lateral directions along the divider, adjacent the near end of the divider, and spaced longitudinally rearwardly from the forward divider finger for engaging the rearward lip of the retainer plate when the forward divider finger is engaged with the forward lip such that the retainer plate is enveloped between the forward and rearward divider fingers;

at least one further tongue extending in longitudinal directions along one of the retainer plate and the divider, adjacent the near end of the divider and placed intermediate the forward and rearward divider fingers, and intermediate the forward and rearward lips, when the forward and rearward divider fingers are engaged respectively with the forward and rearward lips; and at least one further groove extending in longitudinal directions along another of the retainer plate and the divider, adjacent the near end of the divider, the groove being complementary to the further tongue;

a further stabilizing arrangement for stabilizing the divider against inadvertent movements of the far end of the divider in lateral directions within the basal plane when the near end of the divider is secured at the selected lateral location, the further stabilizing arrangement including:

a pair of further keys spaced apart longitudinally from one-another and extending in lateral directions along one of the retainer plate and the divider, adjacent the near end of the divider; and a pair of further keyways spaced apart longitudinally from one-another and extending in lateral directions along another of the retainer plate and the divider, adjacent the near end of the divider;

the further keys and the further keyways, and the further tongue and the further groove, being dimensioned, configured and located relative to one-another for complementary interengagement, with each further key interlocked longitudinally with a complementary further keyway, and the further tongue interlocked with the further groove, the further keys being spaced apart and the further keyways being spaced apart in longitudinal directions by a predetermined longitudinal spacing, and engaged along prescribed lateral spans, and the further tongue and the further groove extending along a prescribed longitudinal length, the longitudinal spacing being great enough, the lateral spans being extensive enough, and the prescribed longitudinal length being great enough such that upon engagement of the forward and rearward divider fingers respectively with the forward and rearward lips, interengagement of the complementary further keys and keyways, and engagement of the further tongue with the further groove, the engagement of the forward and rearward divider fingers respectively with the forward and rearward lips captures the divider upon the retainer plate, with the retainer plate enveloped between the forward and rearward divider fingers, while the engagement of the further tongue with the further groove in concert with interengagement of the complementary further keys and keyways essentially precludes canting of the divider relative to the retainer plate within the basal plane and the divider is stabilized, in alignment with the longitudinal direction.

7. The apparatus of claim 6 wherein the keys and the tongue are on the pusher track assembly, the keyways and the groove are in the retainer plate, the further keys and the further tongue are on the divider, and the further keyways and the further groove are in the retainer plate.

8. The apparatus of claim 6 wherein the keys, the further keys, the keyways, and the further keyways include respective confronting engaging surfaces extending in respective engagement planes generally normal to the basal plane.

9. The apparatus of claim 8 wherein the engagement planes extend along lateral directions.

10. The apparatus of claim 9 wherein the keys and the tongue are on the pusher track assembly, the keyways and the groove are in the retainer plate, the further keys and the further tongue are on the divider, and the further keyways and the further groove are in the retainer plate.

11. The apparatus of claim 6 including two dividers for being spaced apart laterally to locate the dividers aligned longitudinally alongside the path of travel for guiding the packages along the path of travel.

12. The apparatus of claim 11 wherein the keys and the tongue are on the pusher track assembly, the keyways and the groove are in the retainer plate, the further keys and the further tongues are on the respective dividers, and the further keyways and the further grooves are in the retainer plate.

13. The apparatus of claim 11 wherein the keys, the further keys, the keyways, and the further keyways include confronting engaging surfaces extending in respective engagement planes generally normal to the basal plane.

14. The apparatus of claim 13 wherein the engagement planes extend along lateral directions.

15. The apparatus of claim 14 wherein the keys and the tongues are on the pusher track assembly, the keyways and the groove are in the retainer plate, the further keys and the further tongues are on the respective dividers, and the further keyways and the further grooves are in the retainer plate.

16. An apparatus for displaying and dispensing merchandise at a point-of-purchase adjacent a display shelf extending in lateral directions, the merchandise being in the form of packages arranged serially along a path of travel extending longitudinally toward a forward dispensing location placed at the point-of-purchase, the apparatus comprising:

at least one divider for extending along a longitudinal direction adjacent the path of travel in juxtaposition with the serially arranged packages, the divider including a near end for placement adjacent the forward dispensing location, and a far end spaced longitudinally away from the near end;

a securing arrangement for securing the near end of the divider at a selected lateral location along the display shelf, with the divider extending within a basal plane, the near end affixed against inadvertent movement in lateral directions within the basal plane, as well as against inadvertent movement in longitudinal directions within the basal plane, the securing arrangement including a retainer plate for affixation to the display shelf with the retainer plate extending along the lateral directions adjacent the point-of-purchase;

the retainer plate extending longitudinally from a laterally extending forward lip to a laterally extending rearward lip, and not beyond the forward and rearward lips, such that the retainer plate is bounded by the forward and rearward lips;

a forward divider finger extending in lateral directions along the divider, adjacent the near end of the divider, in place for engaging the forward lip of the retainer plate;

a rearward divider finger extending in lateral directions along the divider, adjacent the near end of the divider and spaced longitudinally rearwardly from the forward divider finger for engaging the rearward lip of the retainer plate when the forward divider finger is engaged with the forward lip such that the retainer plate is enveloped between the forward and rearward divider fingers;

at least one tongue extending in longitudinal directions along one of the retainer plate and the divider, adjacent the near end of the divider and placed intermediate the forward and rearward divider fingers, and intermediate the forward and rearward lips, when the forward and rearward divider fingers are engaged respectively with the forward and rearward lips; and a groove extending in longitudinal directions along another of the retainer plate and the divider, adjacent the near end of the divider, the groove being complementary to the tongue;

a stabilizing arrangement for stabilizing the divider against inadvertent movements of the far end of the divider in lateral directions within the basal plane when the near end of the divider is secured at the selected lateral location, the stabilizing arrangement including:

a pair of keys spaced apart longitudinally from one-another and extending in lateral directions along one of the retainer plate and the divider, adjacent the near end of the divider; and a pair of keyways spaced apart longitudinally from one-another and extending in lateral directions along another of the retainer plate and the divider, adjacent the near end of the divider;

the keys and the keyways, and the tongue and the groove, being dimensioned, configured and located relative to one-another for complementary interengagement, with each key interlocked longitudinally with a complementary keyway, and the tongue interlocked with the groove, the keys being spaced apart and the keyways being spaced apart in longitudinal directions by a predetermined longitudinal spacing, and engaged along prescribed lateral spans, and the tongue and the groove extending along a prescribed longitudinal length, the longitudinal spacing being great enough, the lateral spans being extensive enough, and the prescribed longitudinal length being great enough such that upon engagement of the forward and rearward divider fingers respectively with the forward and rearward lips, interengagement of the complementary keys and keyways, and engagement of the tongue with the groove, the engagement of the forward and rearward divider fingers respectively with the forward and rearward lips captures the divider upon the retainer plate, with the retainer plate enveloped between the forward and rearward divider fingers, while the engagement of the tongue and the groove in concert with interengagement of the complementary keys and keyways essentially precludes canting of the divider relative to the retainer plate within the basal plane and the divider is stabilized, in alignment with the longitudinal direction.

17. The apparatus of claim 16 wherein the keys and the tongue are on the divider and the keyways and the groove are in the retainer plate.

18. The apparatus of claim 16 wherein the keys and the keyways include confronting engaging surfaces extending in engagement planes generally normal to the basal plane.

19. The apparatus of claim 18 wherein the engagement planes extend along lateral directions.

20. The apparatus of claim 18 wherein the keys and the tongue are on the divider and the keyways and the groove are in the retainer plate.

* * * * *